US009302476B2

(12) United States Patent
Tsubota

(10) Patent No.: US 9,302,476 B2
(45) Date of Patent: Apr. 5, 2016

(54) LIQUID EJECTING APPARATUS

(71) Applicant: SEIKO EPSON CORPORATION, Tokyo (JP)

(72) Inventor: Shinichi Tsubota, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/637,243

(22) Filed: Mar. 3, 2015

(65) Prior Publication Data

US 2015/0251417 A1 Sep. 10, 2015

Related U.S. Application Data

(60) Provisional application No. 61/949,132, filed on Mar. 6, 2014.

(51) Int. Cl.
*B41J 2/045* (2006.01)
*B41J 2/14* (2006.01)

(52) U.S. Cl.
CPC ..... *B41J 2/04588* (2013.01); *B41J 2/04581* (2013.01); *B41J 2/1433* (2013.01)

(58) Field of Classification Search
CPC .. B41J 2/04541; B41J 2/04543; B41J 2/0458; B41J 2/04581; B41J 2/04588; B41J 29/38; B41J 29/393
USPC ..... 347/5, 9–11
See application file for complete search history.

(56) References Cited

U.S. PATENT DOCUMENTS

2002/0018083 A1* 2/2002 Sayama ..... 347/5
2010/0097423 A1* 4/2010 Inoue ..... 347/47
2012/0320124 A1* 12/2012 Saito et al. ..... 347/21

FOREIGN PATENT DOCUMENTS

JP 2003-328282 11/2003
JP 2005-029900 2/2005

* cited by examiner

*Primary Examiner* — Manish S Shah
*Assistant Examiner* — Roger W Pisha, II
(74) *Attorney, Agent, or Firm* — Workman Nydegger

(57) ABSTRACT

To provide a liquid ejecting apparatus which is able to eject a liquid where the surface tension is comparatively low in a stable manner. In relation to a driving signal for ejecting ink for textile printing where the surface tension is 22 [mN] or more and 30 [mN] or less from a nozzle, the interval between the first ejection driving pulse DP1 and the second ejection driving pulse DP2 and the interval between the second ejection driving pulse DP2 of a cycle T(n) and the first ejection driving pulse DP1 of a cycle T(n+1) are set to be Δt1. Due to this, in a case where medium dots are continuously formed over a plurality of continuous cycles, the ejecting intervals of the ink are set to be constant.

6 Claims, 7 Drawing Sheets

LIQUID EJECTING APPARATUS

CROSS-REFERENCE TO RELATED APPLICATIONS

This application claims the benefit of U.S. Provisional application 61/949,132 filed Mar. 6, 2014, titled "LIQUID EJECTING APPARATUS", which is incorporated herein by reference in its entirety.

TECHNICAL FIELD

The invention relates to a liquid ejecting apparatus such as an ink jet recording apparatus, in particular, to a liquid ejecting apparatus which handles a liquid where the surface tension is comparatively low.

BACKGROUND ART

The liquid ejecting apparatus is provided with a liquid ejecting head and is an apparatus which ejects (discharges) various types of liquid from the liquid ejecting head. Examples of the liquid ejecting apparatus include image recording apparatuses such as an ink jet printer (referred to below simply as a printer) or an ink jet plotter; however, recently, the invention has been applied to various types of manufacturing apparatuses which take advantage of the feature that it is possible to accurately land extremely small amounts of liquid at predetermined positions. For example, the invention is applied to display manufacturing apparatuses which manufacture color filters for liquid crystal displays or the like, electrode forming apparatuses which form electrodes for organic EL (Electro Luminescence) displays, FEDs (field emission displays), or the like, and chip manufacturing apparatuses which manufacture biochips (biochemical elements). Then, ink is ejected in liquid form by a recording head for an image recording apparatus and a solution of each coloring material of R (Red), G (Green), and B (Blue) is ejected by a coloring material ejecting head for a display manufacturing apparatus. In addition, electrode material is ejected in liquid form by an electrode material ejecting head for an electrode forming apparatus and a solution of bio-organic matter is ejected by a bio-organic matter ejecting head for a chip manufacturing apparatus.

A printer which is one type of the liquid ejecting apparatus described above is provided with an ink jet recording head which is one type of liquid ejecting head (referred to below simply as a recording head). The recording head is configured so as to eject ink from a nozzle by generating pressure variations in ink inside a pressure chamber which is a part of a flow path of a head inner section by driving a pressure generating means such as a piezoelectric element by selectively applying a driving waveform (driving pulses) to the pressure generating means, and controlling the pressure variations.

The printer described above includes printers which are used in printing applications using a transfer textile printing system. Out of these transfer textile printing systems, one which is known as sublimation transfer textile printing is a method where a pattern or the like is printed by ejecting dye ink with respect to a transfer sheet using the printer and the pattern or the like which is printed on the transfer sheet is transferred to a transfer object (for example, a fabric made of polyester or the like). In more detail, by heating the transfer sheet and the transfer object in an overlaid state from both sides using heaters or the like, the coloring material of the dye ink on the side of the transfer sheet is sublimated by the heat to permeate to the transfer object side and subsequently transferred thereto by cooling (for example, refer to PTL 1 and PTL 2). According to such a system, textile printing is possible using a printer of the related art while suppressing costs.

In order to satisfy the requirements for inks for textile printing, the ink composition which is used in the transfer textile printing system described above (appropriately referred to below as ink for textile printing or simply as ink) includes a dispersion dye and a dispersing agent and a surfactant is also added in order to increase the permeation with respect to the transfer object by lowering the surface tension. Due to this, the ink composition has characteristics which are suitable for textile printing; however, there is a tendency for the surface tension of the ink for textile printing to be low in comparison with aqueous inks which are typically used in the printers described above.

CITATION LIST

Patent Literature

[PTL 1] JP-A-2005-029900
[PTL 2] JP-A-2003-328282

SUMMARY OF INVENTION

Technical Problem

In a case where ink for textile printing where the surface tension is low as described above is ejected by a printer under the same conditions as a typical aqueous ink (the same driving waveform, approximately the same environmental temperature, and the like), the ink flying speed is slow while the amount per droplet of ink (weight and volume) has a tendency to increase in comparison with a case where a typical aqueous ink is ejected, and the residual vibration of the ink inside the nozzles and the pressure chambers after ejecting is also slightly larger. When the voltage of the driving waveform is increased to increase the flying speed of the ink, the amount of ink which is ejected also increases along with the increase in voltage. On the other hand, when the gradient (potential change rate) of the elements of drawing in and pushing out of the meniscus according to the driving waveform is set to be steep in order to increase the flying speed, the residual vibration increases and there is a problem in that the ejection stability is deteriorated. That is, when the residual vibration increases, in a case where the ink is ejected continuously, in particular, in a case where the ink is ejected at a higher frequency, the amount of the ink which is ejected from the nozzles and the flying speed are greatly changed with respect to the target values depending on the phase of the residual vibration.

The invention was created in consideration of the above circumstances and has an object of providing a liquid ejecting apparatus which is able to stably eject a liquid where the surface tension is comparatively low.

Solution to Problem

A liquid ejecting apparatus of the invention is proposed in order to achieve the object described above and is provided with a liquid ejecting head which ejects a liquid where a surface tension is 22 [mN] or more and 30 [mN] or less from a nozzle, where ejecting intervals are set to be constant when the liquid is continuously ejected.

Since the invention is configured such that ejecting intervals are set to be constant when a liquid where the surface tension is 22 [mN] or more and 30 [mN] or less is continuously ejected, the size of the residual vibration during each ejection (the residual vibration which is generated by the ejection immediately prior thereto) is substantially averaged without variations, in other words, the extent of the absolute influence with respect to the next ejection due to the residual vibration is reduced since the residual vibration due to the ejection which was performed previously is at least suppressed from being extremely large at the time when ejection is performed. Due to this, each ejection is stabilized. As a result, even in a case where a liquid where the surface tension is 22 [mN] or more and 30 [mN] or less is ejected, the target liquid amount and the flying speed are obtained regardless of the ejection frequency, and stable ejection is possible.

In the configuration described above, the liquid which is ejected from the liquid ejecting head relates to one or more landing droplets which are formed by landing on a landing target, and it is possible to form first landing droplets of which the relative size is the smallest, second landing droplets of which the relative size is the largest, and third landing droplets with a size between the first landing droplets and the second landing droplets, and it is desirable to adopt a configuration where ejecting intervals are set to be constant at least when the third landing droplets are formed.

According to the configuration described above, since the usage rate (the formation rate) of the third landing droplets of a size between the first landing droplets and the second landing droplets is high in a transfer textile printing system, the effectiveness is increased.

In the configuration described above, it is more desirable that ejecting intervals be set to be constant when the first landing droplets are formed and ejecting intervals be set to be constant when the second landing droplets are formed.

According to this configuration, since the intervals at which ink is ejected are configured to be set to be constant in a case where landing droplets with various sizes are continuously formed, it is possible to secure the ejection stability even in a case where landing droplets with various sizes are formed.

In addition, in the configuration described above, it is desirable that a configuration be adopted where it is possible to generate a vibration waveform which vibrates the liquid to an extent that the liquid is not ejected from the nozzle by driving a pressure generating means, and the vibration waveform has a first element which changes from a reference potential to a first potential, a second element which changes from the first potential to a second potential exceeding the reference potential, a third element which changes from the second potential to a third potential on the first potential side, and a fourth element which changes from the third potential to the reference potential.

According to this configuration, it is possible to suppress thickening of the liquid by vibrating (micro-vibration) the liquid by applying the vibration waveform described above to a pressure generating means which corresponds to the nozzle where the liquid is not ejected at predetermined periods. In addition, since the vibration waveform of this configuration has a comparatively long waveform length, in a case where the ejecting of the liquid is performed at shorter cycles, in other words, in a case where the time until the next ejection after the micro-vibration is shorter, there is a tendency for the influence of the residual vibration to easily appear; however, since the intervals at which the liquid is ejected are configured to be set to be constant, the size of the residual vibration during each ejection is substantially averaged and the waveform length in relation to the vibration waveform is long but the residual vibration is small, whereby the extent of the absolute influence with respect to the next ejection due to the residual vibration is reduced in comparison with a configuration where variations in the magnitude of the residual vibration during ejecting are large. Due to this, each ejection is stabilized.

In the configuration described above, it is possible to adopt a configuration where the liquid includes a dispersion dye and at least one type of silicon-based surfactant or fluorine-based surfactant.

In addition, in the invention, a case where the surface tension of the liquid is 22 [mN] or more and 25 [mN] or less is more suitable.

Then, it is possible to adopt a configuration where the liquid includes a penetrating agent with a HLB value of 17 or more and 30 or less.

DESCRIPTION OF EMBODIMENTS

Below, embodiments for realizing the invention will be described with reference to the attached diagrams. Here, in the embodiments which are described below, various types of limitations are applied as favorable specific examples of the invention; however, the range of the invention is not limited to these aspects unless it is particularly stated in the description below that the invention is limited. In addition, an ink jet type recording apparatus (below, a printer) will be described below as an example of a liquid ejecting apparatus of the invention.

Figure 1:
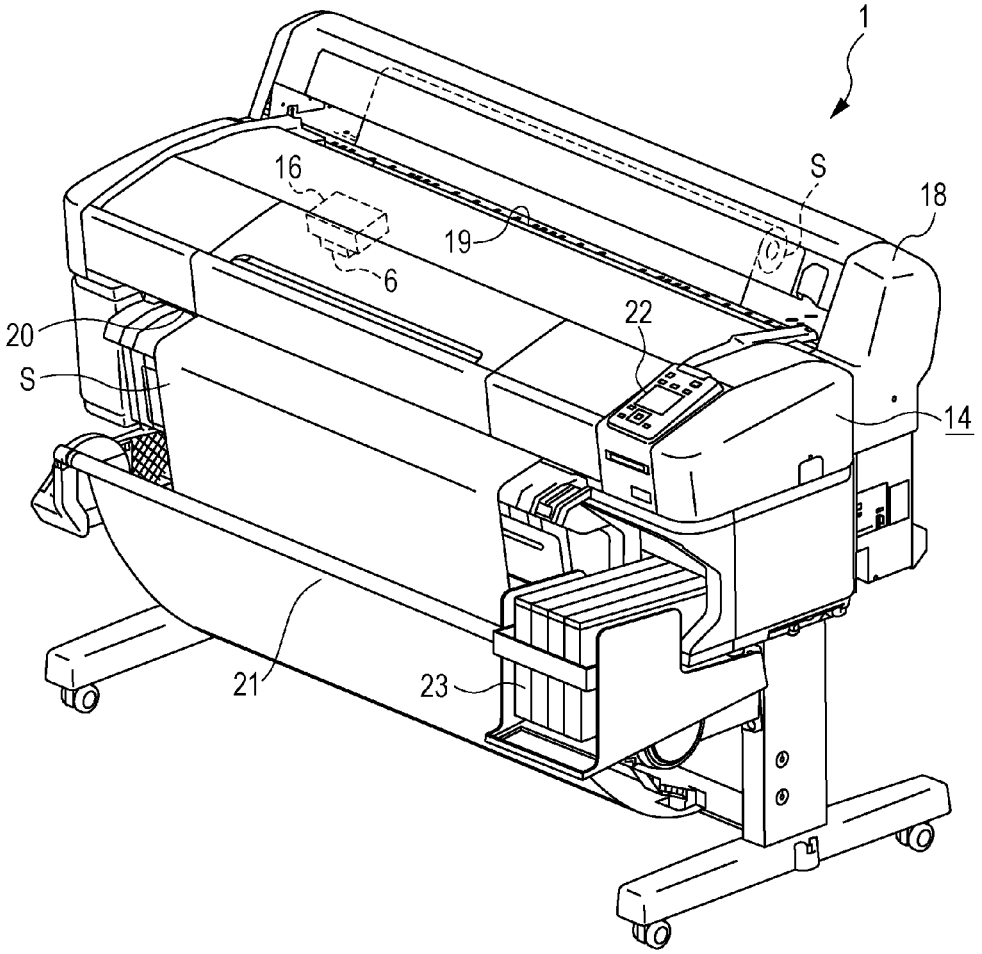
FIG. 1 is a perspective diagram which illustrates a configuration of a printer.
Figure 2:
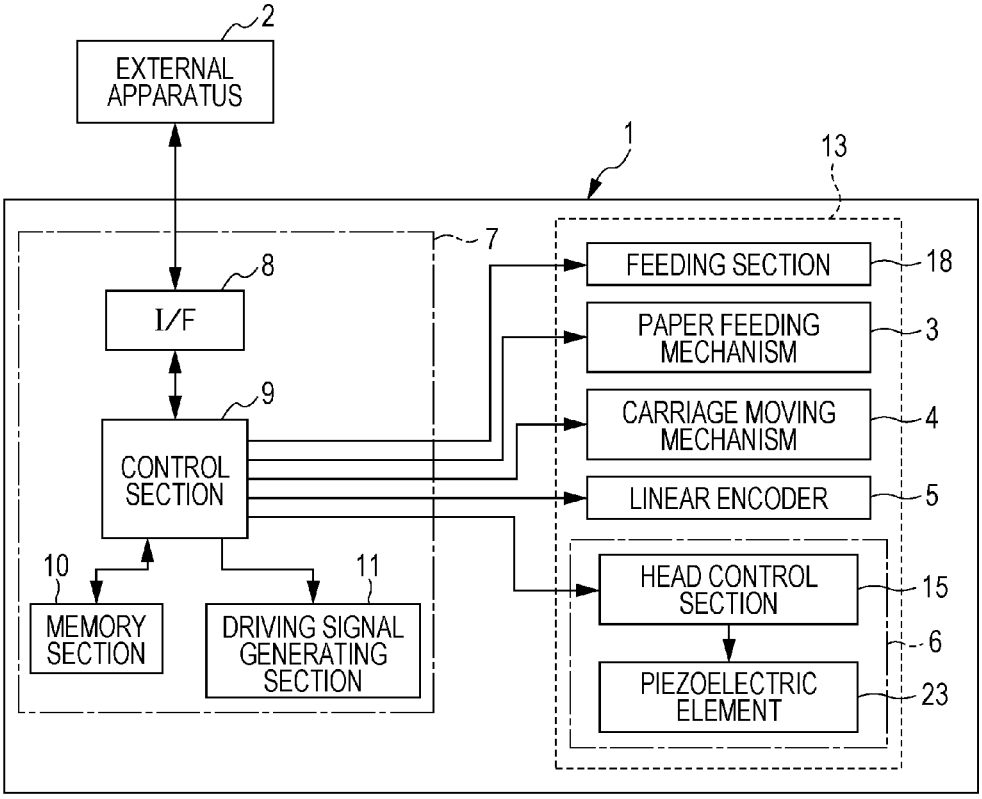
FIG. 2 is a block diagram which illustrates an electrical configuration of the printer.

FIG. 1 is a perspective diagram which illustrates a configuration of a printer 1 and FIG. 2 is a block diagram which illustrates an electrical configuration of the printer 1. An external apparatus 2 is an electronic apparatus such as, for example, a computer, a digital camera, or a cell phone. The external apparatus 2 is electrically connected with the printer 1 wirelessly or by a cable and transmits printing data according to the image or the like to the printer 1 in order to print images, text, or the like onto a recording medium (a liquid landing target) such as a transfer sheet S or the like in the printer 1.

The printer 1 in the present embodiment has a printer controller 7 and a print engine 13. A recording head 6 which is one type of liquid ejecting head is arranged inside an apparatus body 14 by being attached to the bottom surface side of a carriage 16. Then, the carriage 16 is configured so as to be able to be moved back and forth by a carriage moving mechanism 4 which is provided inside the apparatus body 14. That is, the printer 1 sequentially transports a transfer sheet S using a paper feeding mechanism 3 which is provided inside the apparatus body 14 and also records an image or the like by ejecting ink for textile printing (an ink composition) which is one type of liquid in the invention from a nozzle 37 (FIG. 3) of the recording head 6 while relatively moving the recording head 6 in the width direction (the main scanning direction) of the transfer sheet S and landing the ink on the transfer sheet S. Then, by heating the transfer sheet S and the transfer object in an overlaid state using heaters or the like while adding a constant pressure from one side or both sides in the subsequent process, the coloring material (a dispersion dye) of the ink for textile printing on the transfer sheet S side is sublimated by the heat to permeate to the transfer object side. Then, the coloring material is fixed to the transfer object by a subsequent cooling process.

A feeding section 18 which configures a part of the transporting mechanism 3 is provided to the rear of the apparatus body 14 in the printer 1 of the present embodiment. The transfer sheets S are loaded in a state of being wound in a cylindrical shape inside the feeding section 18. The transfer sheets S which are sent out from the feeding section 18 are introduced to an inner section of the apparatus body 14 through a paper feeding opening 19 which is formed on the rear surface of the apparatus body 14. On the other hand, a paper discharging opening 20 for discharging the transfer sheet S to the outside of the apparatus body 14 is formed on the front surface side of the apparatus body 14 which is the opposite side to the feeding section 18. The transfer sheet S which is fed from the feeding section 18 is transported by the paper feeding mechanism 3 from the paper feeding opening 19 side toward the paper discharging opening 20 side. Then, a sheet receiving unit 21 which receives the transfer sheet S which is discharged from the paper discharging opening 20 is provided at a position which is lower than the paper discharging opening 20 on the front surface side of the apparatus body 14. In addition, an operation panel 22 for performing a setting operation or an input operation is provided on one end side (the right hand front side in FIG. 1) of a front surface upper section of the apparatus body 14 in the main scanning direction. Furthermore, an ink cartridge 23 (a liquid accommodating member) which is able to store ink for textile printing is mounted to be lower than the operation panel 22 on the front surface of the apparatus body 14. A plurality of the ink cartridges 23 (four in the present embodiment) are provided corresponding to the types or colors of the ink compositions. Then, the ink for textile printing which is stored in the ink cartridge 23 is supplied to the recording head 6 through an ink supply tube (which is not shown in the diagram) which is arranged in an inner section of the apparatus body 14.

The printer controller 7 is a control unit which controls each of the sections of the printer. The printer controller 7 in the present embodiment has an interface (I/F) section 8, a control section 9, a memory section 10, and a driving signal generating section 11. An interface section 8 performs transmission and reception of state data of the printer when sending printing data or a printing command from the external apparatus 2 to the printer 1 or outputting state information of the printer 1 to the external apparatus 2 side. The control section 9 is a calculation processing apparatus for controlling the entire printer. The memory section 10 is an element which stores data which is used for a program or various types of control of the control section 9 and includes a ROM, a RAM, and an NVRAM (a non-volatile memory element). The control section 9 controls each of the units according to a program which is stored in the memory section 10. In addition, the control section 9 in the present embodiment generates ejecting data which indicates at what timing ink is ejected from which nozzle 37 during the recording process based on the printing data from the external apparatus 2 and transmits the ejecting data to a head control section 15 of the recording head 6. The driving signal generating section 11 (a driving waveform generating means) generates a driving signal which includes a driving pulse for recording an image or the like by ejecting ink (ink for textile printing) with respect to the transfer sheet.

Next, description will be given of the print engine 13. The print engine 13 is provided with the paper feeding mechanism 3, the carriage moving mechanism 4, a linear encoder 5, the feeding section 18, the recording head 6, and the like as shown in FIG. 2. The carriage moving mechanism 4 is formed of the carriage 16 to which the recording head 6 is attached, a driving motor (for example, a DC motor) which moves the carriage 16 via a timing belt or the like, and the like (which are not shown in the diagram), and moves the recording head 6 which is mounted on the carriage 16 in the main scanning direction. In addition, the linear encoder 5 outputs an encoder pulse according to the scanning position of the recording head 6 which is mounted on the carriage 16 to the printer controller 7 as position information regarding the main scanning direction. The printer controller 7 is able to acquire the scanning position (the current position) of the recording head 6 based on the encoder pulse which is received from the linear encoder 5 side.

Figure 3:
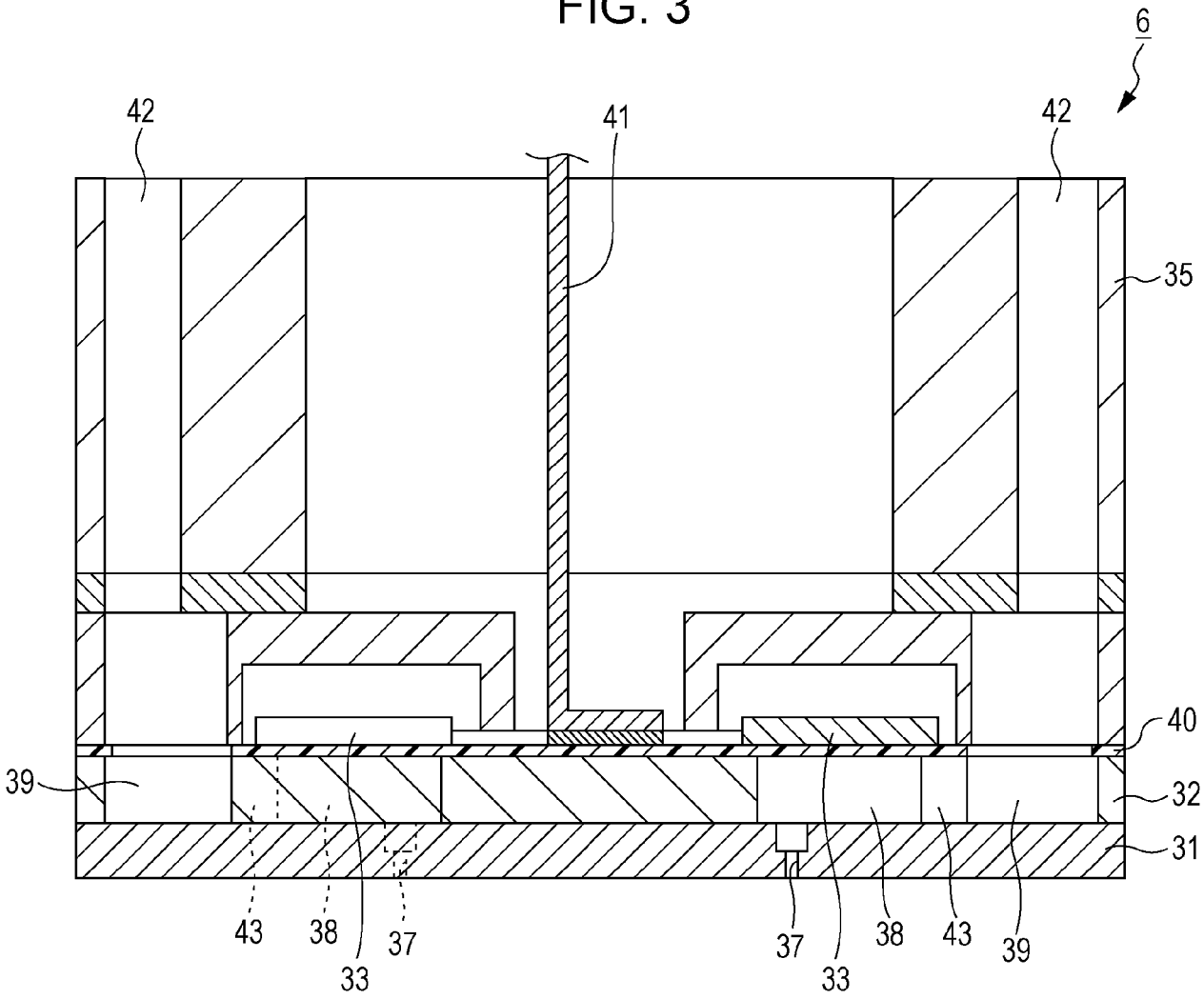
FIG. 3 is a cross-sectional diagram which illustrates an internal configuration of a recording head.

FIG. 3 is a cross-sectional diagram which illustrates main sections of an inside configuration of the recording head 6.

The recording head 6 in the present embodiment is schematically configured of a nozzle plate 31, a flow path substrate 32, a piezoelectric element 33, and the like and is attached to a case 35 in a state where these members are laminated. The nozzle plate 31 is a plate-shaped member where a plurality of the nozzles 37 are set up in a row along the same direction at a pitch corresponding to a dot forming density. In the present embodiment, a plurality of nozzle rows (a type of nozzle group), which are configured of a plurality of the lined up nozzles 37, are lined up along on the nozzle plate 31. The nozzle rows are provided in a number, which corresponds to the types, colors, or the like of the ink. Then, the surface on the side of the nozzle plate 31 where ink is ejected corresponds to a nozzle surface.

A plurality of pressure chambers 38 which are partitioned by a plurality of partition walls are formed corresponding to each of the nozzles 37 in the flow path substrate 32. A common liquid chamber 39 which partitions a part of the common liquid chamber 39 is formed outside of a row of the pressure chambers 38 in the flow path substrate 32. The common liquid chamber 39 individually communicates with each of the pressure chambers 38 via an ink supply opening 43. In addition, ink (ink for textile printing) from the ink cartridge 17 side is introduced to the common liquid chamber 39 through an ink introduction path 42 of the case 35. The piezoelectric element 33 (a type of pressure generating means) is formed on the upper surface of the opposite side to the nozzle plate 31 side of the flow path substrate 32 via an elastic film 40. In the elastic film 40, a portion which closes an upper section opening of the pressure chamber 38 functions as an operating section which is displaced along with bending and deformation of the piezoelectric element 33. The piezoelectric element 33 is formed by sequentially laminating a lower electrode film made of metal, a piezoelectric body layer formed of, for example, lead zirconate titanate or the like, and an upper electrode film formed of metal (none of which are shown in the diagram). The piezoelectric element 33 is a so-called bending mode piezoelectric element and is formed so as to cover the upper section of the pressure chamber 38. In the present embodiment, two piezoelectric element rows corresponding to the two nozzle rows are lined up in a direction which is orthogonal to the nozzle row in a state where the piezoelectric elements 33 alternate as seen from the nozzle row direction. Each of the piezoelectric elements 33 changes shape by a driving signal being applied through a wiring member 41. Due to this, pressure variations occur in the ink inside the pressure chamber 38 corresponding to the piezoelectric elements 33 and the ink is ejected from the nozzle 37 by controlling the pressure variations in the ink.

Next, description will be given of an ink composition (ink for textile printing) which is used for sublimation transfer textile printing where the printer 1 described above is used. The ink composition according to the present embodiment includes a dispersion dye, and at least one type of silicon-based surfactant or fluorine-based surfactant. The dispersion dye is a dye which is favorably used for dyeing hydrophobic synthetic fibers such as polyester, nylon, and acetate and is a compound which is insoluble or sparingly soluble in water. The dispersion dye which is used in the ink composition in the present embodiment is not particularly limited; however, specific examples will be given below.

Examples of a yellow dispersion dye include C.I. Disperse Yellow 3, 4, 5, 7, 9, 13, 23, 24, 30, 33, 34, 42, 44, 49, 50, 51, 54, 56, 58, 60, 63, 64, 66, 68, 71, 74, 76, 79, 82, 83, 85, 86, 88, 90, 91, 93, 98, 99, 100, 104, 108, 114, 116, 118, 119, 122, 124, 126, 135, 140, 141, 149, 160, 162, 163, 164, 165, 179, 180, 182, 183, 184, 186, 192, 198, 199, 202, 204, 210, 211, 215, 216, 218, 224, 227, 231, 232, and the like.

Examples of an orange dispersion dye include C.I. Disperse Orange 1, 3, 5, 7, 11, 13, 17, 20, 21, 25, 29, 30, 31, 32, 33, 37, 38, 42, 43, 44, 45, 46, 47, 48, 49, 50, 53, 54, 55, 56, 57, 58, 59, 61, 66, 71, 73, 76, 78, 80, 89, 90, 91, 93, 96, 97, 119, 127, 130, 139, 142, and the like.

Examples of a red dispersion dye include C.I. Disperse Red 1, 4, 5, 7, 11, 12, 13, 15, 17, 27, 43, 44, 50, 52, 53, 54, 55, 56, 58, 59, 60, 65, 72, 73, 74, 75, 76, 78, 81, 82, 86, 88, 90, 91, 92, 93, 96, 103, 105, 106, 107, 108, 110, 111, 113, 117, 118, 121, 122, 126, 127, 128, 131, 132, 134, 135, 137, 143, 145, 146, 151, 152, 153, 154, 157, 159, 164, 167, 169, 177, 179, 181, 183, 184, 185, 188, 189, 190, 191, 192, 200, 201, 202, 203, 205, 206, 207, 210, 221, 224, 225, 227, 229, 239, 240, 257, 258, 277, 278, 279, 281, 288, 298, 302, 303, 310, 311, 312, 320, 324, 328, and the like.

Examples of a violet dispersion dye include C.I. Disperse Violet 1, 4, 8, 23, 26, 27, 28, 31, 33, 35, 36, 38, 40, 43, 46, 48, 50, 51, 52, 56, 57, 59, 61, 63, 69, 77, and the like. Examples of a green dispersion dye include C.I. Disperse Green 9 and the like. Examples of a brown dispersion dye include C.I. Disperse Brown 1, 2, 4, 9, 13, 19, and the like. Examples of a blue dispersion dye include C.I. Disperse Blue 3, 7, 9, 14, 16, 19, 20, 26, 27, 35, 43, 44, 54, 55, 56, 58, 60, 62, 64, 71, 72, 73, 75, 79, 81, 82, 83, 87, 91, 93, 94, 95, 96, 102, 106, 108, 112, 113, 115, 118, 120, 122, 125, 128, 130, 139, 141, 142, 143, 146, 148, 149, 153, 154, 158, 165, 167, 171, 173, 174, 176, 181, 183, 185, 186, 187, 189, 197, 198, 200, 201, 205, 207, 211, 214, 224, 225, 257, 259, 267, 268, 270, 284, 285, 287, 288, 291, 293, 295, 297, 301, 315, 330, 333, and the like. Examples of a black dispersion dye include C.I. Disperse Black 1, 3, 10, 24, and the like.

The dispersion dyes given as examples above may be used as one type alone or may be used as mixed colors combining two or more types. In addition, examples of commercial products of the dispersion dyes include Oracet Yellow 8GF (product name, C.I. Disperse Yellow 82 manufactured by Ciba Geigy Corp.), Aizenzotto Yellow 5 (product name, C.I. Disperse Yellow 3 manufactured by Hodogaya Chemical Co., Ltd.), Sumiplast Yellow HLR (product name, C.I. Disperse Yellow 54 manufactured by Sumitomo Chemical Co., Ltd.), Kaya Set Yellow A-G (product name, C.I. Disperse Yellow 54 manufactured by Nippon Kayaku Co., Ltd.), Diaresin Yellow H2G (product name, C.I. Disperse Yellow 160 manufactured by Mitsubishi Chemical Co., Ltd.), Oil Yellow 54 (product name, C.I. Disperse Yellow 54 manufactured by Chuo Synthetic Chemical Co., Ltd.), Diaresin Red H (product name, C.I. Disperse Red 5 manufactured by Mitsubishi Chemical Co., Ltd.), Sumiplast Red B-2 (product name, C.I. Disperse Red 191 manufactured by Sumitomo Chemical Co., Ltd.), Kaya Set Red B (product name, C.I. Disperse Red 60 manufactured by Nippon Kayaku Co., Ltd.), Filester Violet BA (product name, C.I. Disperse Violet 57 manufactured by Ciba Geigy Corp.), Plast Red 8335 (product name, C.I. Disperse Violet 17 manufactured by Arimoto Chemical Co., Ltd.), Plast Red 8375 (product name, C.I. Disperse Red 60 manufactured by Arimoto Chemical Co., Ltd.), Plast Blue 8516 (product name, C.I. Disperse Blue 14 manufactured by Arimoto Chemical Co., Ltd.), and the like.

The content of the disperse dye in the ink for textile printing which is an ink composition according to the present embodiment is preferably 0.1 mass % or more to 10 mass % or less, more preferably 0.25 mass % or more to 9 mass % or less, and particularly preferably 1 mass % or more to 8 mass % or less from the point of view of the dyeing property and the solubilizing ability of the dispersion dye.

In addition, the ink for textile printing in the present embodiment includes at least one type of silicon-based surfactant and fluorine-based surfactant. Examples of the effects of these surfactants include improving the permeability with respect to the transfer object such as a fabric in addition to promoting the dissolution of a dispersing agent and a penetrating agent which each have a property of being difficult to dissolve in a solvent by adjusting the surface tension of the ink composition. Here, description will be given below of the dispersing agent and the penetrating agent. It is possible to use the surfactant described below as one type alone or by mixing a plurality thereof and it is possible to adjust the surface tension by changing the type or the composition of the surfactant. The total content of at least one type of the silicon-based surfactant and the fluorine-based surfactant with respect to the total amount of the ink composition is 0.05 mass % or more to 1.5 mass % or less, preferably 0.05 mass % or more to 1.2 mass % or less, and more preferably 0.1 mass % or more to 1 mass % or less. It is possible for the surface tension of the ink composition to be 22 [mN/m] or more to 30 [mN/m] or less when the content of the surfactant is within the range described above.

Examples of the silicon-based surfactant include a surfactant which has a polysiloxane structure which has a siloxane unit. In addition, other than a hydrogen atom, hydrocarbon groups which are unmodified, ether-modified, polyester-modified, epoxy-modified, amine-modified, carboxyl-modified, fluorine-modified, alkyloxy-modified, mercapto-modified, (meth)acryl-modified, phenol-modified, phenyl-modified, carbinol-modified, or aralkyl-modified, may independently exist in the side chain of the polysiloxane, and more preferably the side chain may have a hydrocarbon group which is unmodified, ether-modified, or polyester-modified. Specific examples of the silicon-based surfactant which has a dimethylsiloxane unit include BYK-347 and BYK-348 (manufactured by BYK-Chemie Japan Corp.), and the like. In addition, examples of polyether-modified organosiloxane include BYK-378, BYK-333, and BYK-337 (product names, manufactured by BYK-Chemie Japan Corp.), and the like. In a case where a silicon-based surfactant is used alone with respect to the ink composition, the content of the silicon-based surfactant with respect to the total amount of the ink composition is 0.01 mass % or more to 1.5 mass % or less and preferably 0.05 mass % or more to 1.2 mass % or less.

Examples of a fluorine-based surfactant which is able to be applied to the ink composition in the present embodiment include a surfactant where a part or all of the hydrogen atoms which are bonded with carbon of a hydrophobic group of an ordinary surfactant are replaced with fluorine atoms. Specific examples of the fluorine-based surfactant include perfluoro alkyl sulfonate, perfluoro alkyl carboxylate, perfluoro alkyl phosphoric acid ester, a perfluoro alkyl ethylene oxide adduct, perfluoro alkyl betaine, perfluoro alkyl amine oxide compounds, and the like. Among these, a fluorine-based surfactant which has a perfluoro alkyl group or a perfluoro alkenyl group in the molecule is more preferably used in the ink composition in the present embodiment. In addition, there are fluorine-based surfactants which are anionic, non-ionic, or both; however, it is possible to preferably use any of these. Such fluorine-based surfactants are each commercially sold as, for example, the product Megafac from DIC Corp., the product Surflon from Asahi Glass Co., Ltd., the product Novec from Sumitomo 3M Inc., the product named Zonyls from E.I. Dupont Nemeras and Company Corp. (Dupont Corp.), and the product named Ftergent from Neos Co., Ltd.

Specific examples of commercial products of the fluorine-based surfactants include Surflon S-211, S-131, S-132, S-141, S-144, and S-145 (manufactured by Asahi Glass Co., Ltd.), Ftergent 100 and Ftergent 150 (manufactured by Neos Co., Ltd.), Megafacs F477 (manufactured by DIC Corp.), FC-170C, FC-430, and Fluorad FC4430 (manufactured by Sumitomo 3M Inc.), FSO, FSO-100, FSN, FSN-100, and FS-300 (manufactured by Dupont Corp.), FT-250 and 251 (manufactured by Neos Co., Ltd.), and the like. The fluorine-based surfactant may be used as one type alone or two or more types may be used together. In a case where the fluorine-based surfactant is used as one type alone with respect to the ink composition, the content of the fluorine-based surfactant with respect to the total amount of the ink composition is 0.01 mass % or more to 1.2 mass % or less, preferably 0.05 mass % or more to 1 mass % or less, and more preferably 0.1 mass % or more to 0.75 mass % or less.

Other than this, it is possible for the ink composition in the present embodiment to contain water, a dispersing agent, a penetrating agent, and other addition agents as appropriate.

Water is the medium which is the main part of the ink composition and a component which is evaporated by drying after being attached to the recording medium. It is preferable that the water be pure water or ultrapure water, where as many ionic impurities as possible are removed, such as deionized water, ultrafiltration water, reverse osmosis water, or distilled water. In addition, since it is possible to prevent the generation of mold or bacteria in a case where a pigment dispersion and an ink composition where the pigment dispersion is used are stored for a long period when water which is sterilized by ultraviolet irradiation, hydrogen peroxide addition, or the like is used, the use thereof is favorable.

In addition, the ink composition in the present embodiment contains a dispersing agent for dispersing the dispersion dye. It is possible to favorably use a formaldehyde condensate which is an aromatic sulfonate as a dispersing agent, and specific examples thereof include a formaldehyde condensate which is aromatic sodium sulfonate, a formaldehyde condensate which is aromatic potassium sulfonate, a formaldehyde condensate which is sodium alkylaryl sulfonate, and the like. In addition, it is possible to give Lavilin AN-40 (product name) (manufactured by Dai-ichi Kogyo Seiyaku Co., Ltd.) as an example of a formaldehyde condensate which is methylnaphthalene sodium sulfonate as a commercial product of a formaldehyde condensate which is an aromatic sulfonate. In a case of blending a formaldehyde condensate which is an aromatic sulfonate as a dispersing agent with respect to the ink composition in the present embodiment, 1 mass % or more to 10 mass % or less is preferable, 2 mass % or more to 9 mass % or less is more preferable, and 3 mass % or more to 8 mass % or less is particularly preferable from the point of view of the dispersibility of the dispersion dye.

Furthermore, the ink composition in the present embodiment contains a penetrating agent. The penetrating agent is preferably a type which is able to increase permeability of the dispersion dye to the transfer object (the medium) in textile printing while maintaining the dispersion of the dispersion dye. Examples of such a penetrating agent include a penetrating agent with a high HLB value. Here, the HLB value in the present specification has the meaning of a value which is obtained by the following formula.

$$HLB \text{ value} = 10 \times (IV/OV)$$

In the above formula, IV/OV is an IOB value which is a ratio of Inorganic Value (IV) and Organic Value (OV) based on an organic conceptual diagram.

The organic conceptual diagram is known as an index which predicts the characteristics of an organic compound and is a diagram which is divided into two factors which are organicity (a covalent bonding property) based on the number of carbon atoms and inorganicity (an ion bonding property) based on a substituent group and which maps the two factors on orthogonal coordinates which are referred to as an organic axis and an inorganic axis. When the organic value of one carbon atom is 20, the sum of the inorganic values (IV) and the sum of the organic values (OV) are calculated from the structure of the organic compound using the organic values and inorganic values of each of the substituent groups which are included in the organic compound (for example, refer to 'New Technology and Application of Dispersion & Emulsion Systems', Supervisor: Kunio Furusawa, Publisher: Techno-System Corp., published Jun. 20, 2006, from p. 166).

Description will be given of a calculation example of the inorganic value and the organic value and a specific example of an HLB value, taking triethylene glycol monomethyl ether as an example. Triethylene glycol monomethyl ether includes seven carbon atoms, one OH group, and three ether bonds. Then, in a case of a primary alcohol which has a plurality of ethylene glycol chains, the inorganicity of the first ether bond is 20 and the inorganicity of the remaining two ether bonds is 75. Accordingly, the organic value of triethylene glycol is $20 \times 7 = 140$ and the inorganic value is $100+20+150=270$ and since the IOB value is $270/140=1.93$, the HLB value is $10 \times 1.93 = 19.3$.

In a case where a penetrating agent is blended with the ink composition in the present embodiment, the HLB value thereof is preferably in a range of 17 or more to 30 or less and more preferably 18 or more to 25 or less. It is preferable that such a penetrating agent be selected since it is possible to improve the permeability to a fabric or the like and to secure the storage stability of the ink composition since it is difficult to destroy the dispersion state of the dispersion dye as the hydrophilicity of the penetrating agent is sufficiently high. It is possible to give triethylene glycol monomethyl ether (HLB=19.3), diethylene glycol monomethyl ether (HLB=19.5), 1,2-pentanediol (HLB=20.0), and 1,2-butanediol (HLB=25.0) as examples of a typical penetrating agent where the HLB value is 17 or more to 30 or less, but among these, triethylene glycol monomethyl ether is preferable.

The content of the penetrating agent where the HLB value is 17 or more to 30 or less in the ink composition according to the present embodiment is preferably 1 mass % or more to 15 mass % or less and more preferably 2 mass % or more to 10 mass % or less. In addition, it is possible to use the penetrating agent as one type alone or by mixing two or more types. In addition, the ink composition of the present embodiment may contain a penetrating agent where the HLB value is less than 17. Here, although the penetrating agent where the HLB value is less than 17 is excellent in terms of permeability to a fabric, since the balance between hydrophilicity and hydrophobicity is slightly inclined to the side of hydrophobicity, it is preferable to blend 1 mass % or less with respect to the total amount of the ink composition so as not to have a negative effect on the dispersion state of the dispersion dye. It is possible to give triethylene glycol monobutyl ether (HLB=13.5), 1,2-hexanediol (HLB=16.7), and the like as examples of penetrating agents where the HLB value is less than 17.

The ink composition of the present embodiment is prepared with the blends shown in Table 1. Out of the components described in Table 1, Disperse Red 60 obtained from Nippon Kayaku Co., Ltd. (product name Kaya Set Red B) and Disperse Yellow 54 obtained from Chuo Synthetic Chemical Co., Ltd. (product name Oil Yellow 54) were used as the dispersion dye. As a surfactant, a silicon-based surfactant BYK-348 from BYK-Chemie Japan Corp., a fluorine-based surfactant Surflon S-211 from Asahi Glass Co., Ltd., and an acetylene glycol-based surfactant Surfynol 104 PG50 from Nissin Chemical Industry Co., Ltd. were each obtained and used. As a dispersing agent, the product name Lavilin AN-40 (a formaldehyde condensate which is methylnaphthalene sodium sulfonate) was obtained from Dai-ichi Kogyo Seiyaku Co., Ltd. and used. Triethylene glycol monomethyl ether, triethylene glycol monobutyl ether, and 1,2-hexanediol were each purchased and used as a penetrating agent and, as other addition agents, glycerine and triethanolamine were each purchased and used as reagents. Here, the HLB value of the penetrating agent is noted as the value which is calculated by the above formula (10×(IV/OV)).

After adding deionized water (remainder) and mixing and stirring in a container using a magnetic stirrer for two hours such that these components were blended in the amounts (mass %) described in Table 1, the ink compositions of each of the examples were prepared by filtering with a membrane filter with a 5 μm pore diameter. The surface tension of each of the ink compositions which were obtained was measured using a surface tensiometer CBVP-Z model (manufactured by Kyowa Interface Science Co., Ltd.) and the results are described in Table 1.

TABLE 1

| | | Examples | | | | | | | | |
|---|---|---|---|---|---|---|---|---|---|---|
| | | 1 | 2 | 3 | 4 | 5 | 6 | 7 | 8 | 9 |
| Dispersion Dye | Disperse Red 60 | 5 | — | 5 | — | 5 | 5 | — | 5 | 5 |
| | Disperse Yellow 54 | — | 3 | — | 3 | — | — | 3 | — | — |
| Dispersing Agent | Lavilin AN-40 | 7.5 | 4.5 | 7.5 | 4.5 | 7.5 | 7.5 | 7.5 | 7.5 | 7.5 |
| Surfactant | BYK348 | 0.75 | 0.5 | 0.3 | 0.1 | 0.75 | 0.75 | — | 0.75 | 0.1 |
| | Surflon S211 | — | — | — | — | — | — | 0.1 | — | 0.1 |
| | Surfynol 104 PG50 | — | — | — | — | — | — | — | — | — |
| Penetrating Agent | Triethylene glycol monomethyl ether (HLB = 19.3) | 3 | 5 | 3 | 3 | 3 | 3 | 3 | 3 | 3 |
| | Triethylene glycol monobutyl ether (HLB = 13.5) | — | — | — | — | 1 | — | — | 2.5 | — |
| | 1,2-hexanediol (HLB = 16.7) | — | — | — | — | — | 0.3 | 0.3 | — | — |
| Other Addition Agents | Glycerine | 15 | 15 | 15 | 15 | 15 | 15 | 15 | 15 | 15 |
| | Triethanolamine | 0.5 | 0.5 | 0.5 | 0.5 | 0.5 | 0.5 | 0.5 | 0.5 | 0.5 |
| Water | | Remainder | Remainder | Remainder | Remainder | Remainder | Remainder | Remainder | Remainder | Remainder |
| Surface Tension [mN/m] | | 25 | 22 | 29 | 27 | 25 | 25 | 25 | 25 | 24 |

The permeability of the ink for textile printing of the composition described above with respect to the transfer object is increased while securing the dispersibility of the dispersion dye so as to be suitable for sublimation transfer. However, the above ink for textile printing has a tendency for the surface tension to be lower than aqueous ink which is normally used for recording an image or the like with respect to a recording medium such as a recording sheet in a typical printer. Specifically, with an environmental temperature of 5° C. to 45° C. where the use of the printer 1 may be assumed, the surface tension of the ink for textile printing has a low value such as 22 to 30 [mN] while the surface tension of an aqueous dye ink is 29 to 32 [mN]. Here, it is also possible to increase the surface tension by increasing the addition amount of the penetrating agent described above with respect to the ink for textile printing; however, it is not preferable that the penetrating agent be added to excess, since the dispersing agent which is attached to the dispersion dye surface separates from the dye and the dye precipitates by reacting with water or the like. Due to these circumstances, the amount of the penetrating agent which is added to the ink for textile printing is limited. Then, in a case where the ink for textile printing where the surface tension is comparatively low is ejected from the recording head 6 under the same conditions as a typical aqueous ink in the printer 1, an amount Iw per ink droplet has a tendency to increase while an ink flying speed Vm decreases in comparison with a case where a typical aqueous ink is ejected. This is because the ease of separation of the ink from the meniscus (ease of becoming ink droplets) when the ink is pushed out from the nozzles at the time of ejection depends on the surface tension of the ink. That is, while it is easier to form ink droplets by separating from the meniscus when the surface tension is higher, it is more difficult to separate from the meniscus and form ink droplets when the surface tension is lower. Due to this, since it is difficult to quickly separate the ink droplets from the meniscus in a case where the ink for textile printing where the surface tension is comparatively low is ejected, as a result, the amount of the ink droplets increases to the separation from the meniscus while the flying speed decreases. Then, in a case where ink is continuously ejected in shorter cycles (in a case where ejection is performed with a higher frequency), the tendency described above is more remarkable. In addition, in a case where the ink for textile printing where the surface tension is low is ejected, the residual vibration of the ink inside the nozzles 37 and the pressure chamber 38 after ejection is also slightly larger. When the residual vibration is increased, in a case where ink is continuously ejected, there is a problem that it is not possible to perform ejection in a stable manner since the amount of the ink which is ejected from the nozzles and the flying speed are greatly changed with respect to the target values depending on the phase of the residual vibration. In consideration of this problem, a driving signal (a driving pulse) is configured in the printer 1 in the present embodiment such that it is possible to eject the ink for textile printing described above in a stable manner. Below, description will be given of this point.

Figure 4:
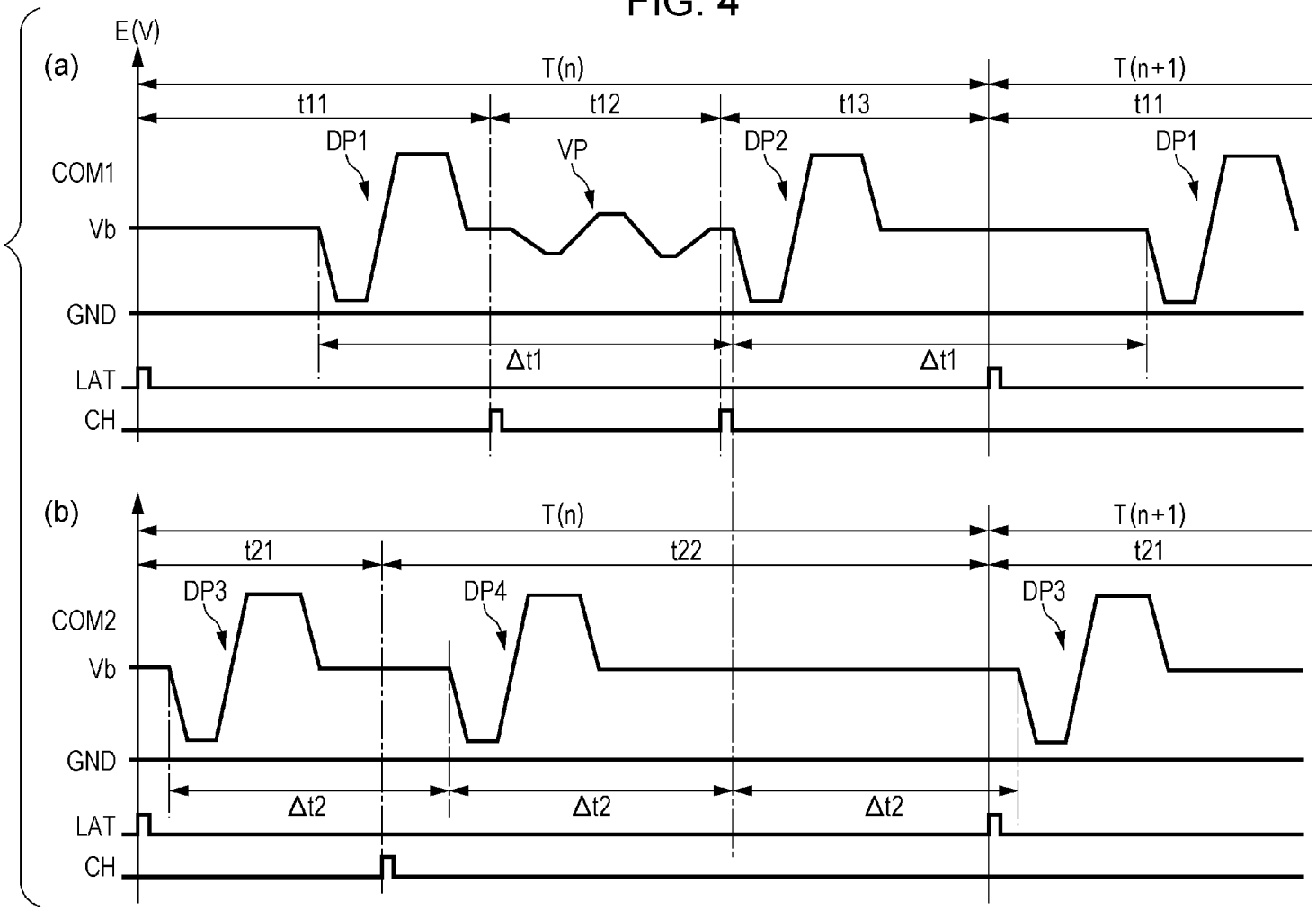
FIG. 4 is a waveform diagram which illustrates a configuration of a driving signal in the present embodiment.

FIG. 4 are waveform diagrams which illustrate a configuration of a driving signal which is generated by the driving signal generating section 11 in the present embodiment. Here, the driving signal generating section 11 described above is configured such that two types of driving signals COM1 and COM2 which are different are repeatedly generated at the same time. FIG. 4(*a*) is a waveform diagram of the first driving signal COM1 and FIG. 4(*b*) is a waveform diagram of the second driving signal COM2. Here, in the same diagram, T(n) shows a predetermined cycle and T(n+1) shows a cycle which comes thereafter. These driving signals COM1 and COM2 are repeatedly generated in the cycle T (a unit cycle) which is determined by a timing signal LAT which is generated based on the encoder pulse described above. The first driving signal COM1 in the present embodiment is a signal which includes a total of three driving pulses within the unit cycle T. The unit cycle T of the first driving signal COM1 in the present embodiment is divided into three periods (pulse generating periods) t11 to t13. Then, a first ejection driving pulse DP1 is generated during the period t11, a micro-vibration driving pulse VP (equivalent to the vibration waveform in the invention) is generated during the period t12, and a second ejection driving pulse DP2 is generated during the period t13. On the other hand, the second driving signal COM2 in the present embodiment is a signal which includes a total of two driving pulses within the unit cycle T. The unit cycle T of the second driving signal COM2 in the present embodiment is divided into two periods t21 and t22. Then, a third ejection driving pulse DP3 is generated during the period t21 and a fourth ejection driving pulse DP4 is generated during the period t22. These ejection driving pulses DP1 to DP4 all have the same configuration (waveform).

The printer 1 in the present embodiment is configured such that multiple gradation recording is possible where dots (equivalent to the landing droplets in the invention) with different sizes are formed on the transfer sheet S which is a recording medium and a recording operation is possible in the present embodiment with a total of four gradations of large dots (equivalent to the second landing droplets in the invention), medium dots (equivalent to the third landing droplets in the invention), small dots (equivalent to the first landing droplets in the invention), and non-ejecting (micro-vibration). Here, the sizes of these dots are relative and differ according to the specifications or the like of the printer. Then, in a case where large dots are formed in a predetermined region (a region where pixels are scheduled to be formed) on the transfer sheet S in the predetermined cycle T during the recording process, the third ejection driving pulse DP3 of the second driving signal COM2, the fourth ejection driving pulse DP4 of the second driving signal COM2, and the second ejection driving pulse DP2 of the first driving signal COM1 are selected in this order and are sequentially applied to the piezoelectric element 33. Due to this, the ink (ink for textile printing) is continuously ejected from the nozzles 37 three times and large dots are formed by these inks landing on the transfer sheet S. In the same manner, in a case where medium dots are formed, the first ejection driving pulse DP1 and the second ejection driving pulse DP2 of the first driving signal COM1 are selected in this order and sequentially applied to the piezoelectric element 33 and medium dots are formed on the transfer sheet S by the ink being continuously ejected from the nozzles 37 twice and landing thereon. In addition, in a case where small dots are formed, only the fourth ejection driving pulse DP4 of the second driving signal COM2 is selected and applied to the piezoelectric element 33 and small dots are formed on the transfer sheet S by the ink being ejected from the nozzles 37 once and landing thereon. On the other hand, the vibration driving pulse VP of the first driving signal COM1 is applied to the piezoelectric element 33 which corresponds to the nozzle 37 where ink is not ejected in a predetermined cycle. Due to this, the meniscus micro-vibrates to an extent where the ink is not ejected in the nozzle 37.

Figure 5:
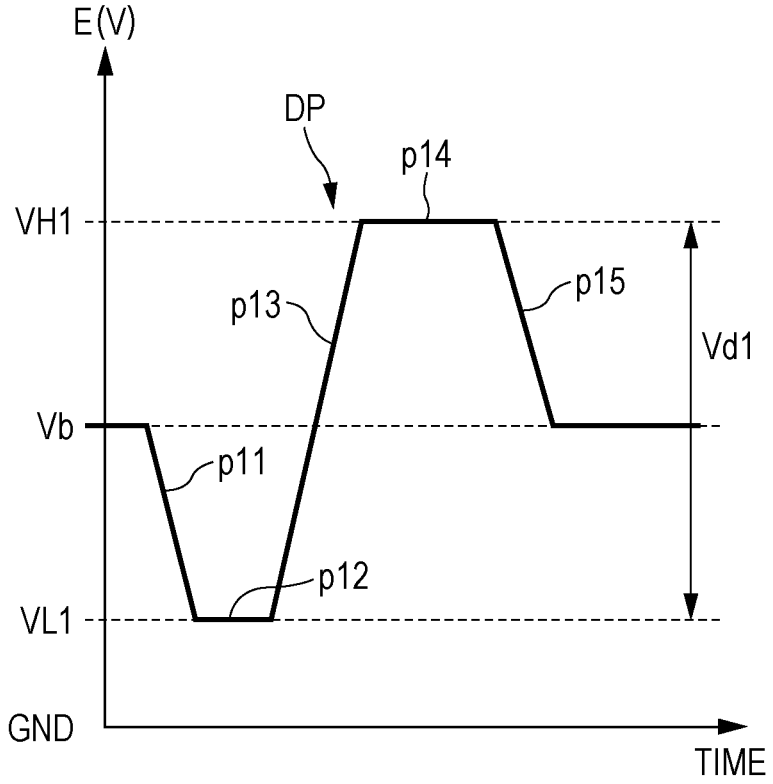
FIG. 5 is a waveform diagram which illustrates a configuration of an ejection driving pulse.

FIG. 5 is a waveform diagram which illustrates a configuration of the ejection driving pulse DP (DP1 to DP4). The ejection driving pulse DP in the present embodiment is formed of a preliminary expanding section p11, an expansion holding section p12, a first shrinking section p13, a first shrinking holding section p14, and a first restoration expanding section p15. The preliminary expanding section p11 is a waveform section where the potentials from a reference potential Vb to a first expansion potential VL1 change to a negative electrode (the first polarity) side. A state where the reference potential Vb is applied to the piezoelectric element 33 is the initial state and the position of the meniscus inside the nozzle 37 in the initial state is an initial stand by position. The expansion holding section p12 is a waveform section where the first expansion potential VL1 which is the end potential of the preliminary expanding section p11 is maintained for a certain time. The first shrinking section p13 is a waveform section where the potential changes to a positive electrode (the second polarity) side with a comparatively steep gradient from the first expansion potential VL1 to a first shrinking potential VH1 exceeding the reference potential Vb. The first shrinking holding section p14 is a waveform section where the first shrinking potential VH1 is maintained for a predetermined time. The first restoration expanding section p15 is a waveform section where the potential is restored from the first shrinking potential VH1 to the reference potential Vb.

In the ejection driving pulse DP described above, the gradient of a potential change in a potential difference (driving voltage) Vd1 from the first expansion potential VL1 to the first shrinking potential VH1 and potential change in the first shrinking section p13 (a potential change rate per unit of time) is set so as to be able to obtain the target amount and flying speed when the ink for textile printing is ejected from the nozzles 37. Due to this, in comparison with the driving pulse (for example, an ejection driving pulse DP' to be described later) of the related art which is used in the ejecting of typical aqueous dye inks, setting is carried out such that the flying speed is relatively high while the liquid amount which is ejected from the nozzles 37 is suppressed. That is, with respect to the driving pulse which is used for ejecting aqueous dye ink, the flying speed Vm is increased in the ejection driving pulse DP in the present embodiment while an increase of the amount of ink droplets is suppressed by setting the inclination of the first shrinking section p13 to be steeper. Due to this, even in a case where the ink for textile printing is ejected, the target ink amount and flying speed are obtained.

Figure 6:
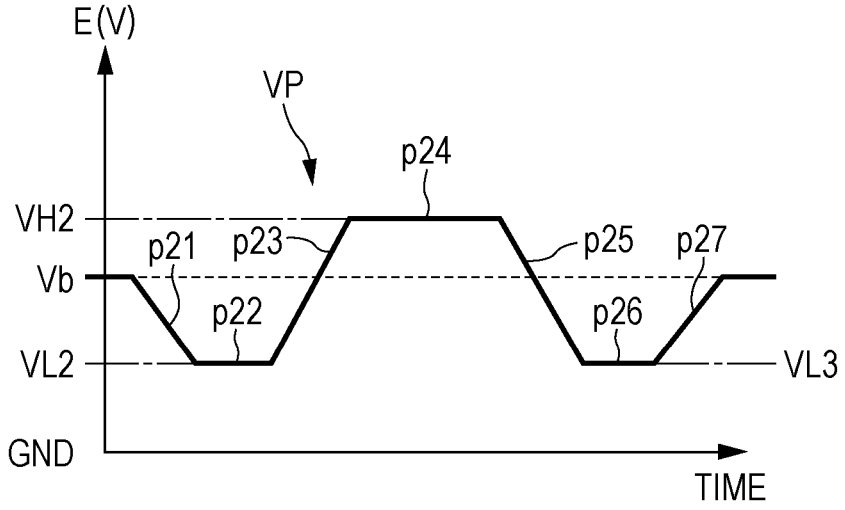
FIG. 6 is a waveform diagram which illustrates a configuration of a micro-vibration driving pulse.

FIG. 6 is a waveform diagram which illustrates a configuration of the micro-vibration driving pulse VP in the present embodiment.

The micro-vibration driving pulse VP in the present embodiment is formed of a first vibration expanding section p21 (equivalent to the first element in the invention), a first vibration expansion holding section p22, a vibration shrinking section p23 (equivalent to the second element in the invention), a vibration shrinking holding section p24, a second vibration expanding section p25 (equivalent to the third element in the invention), a second vibration expansion holding section p26, and a vibration shrinking restoration section p27 (equivalent to the fourth element in the invention). The first vibration expanding section p21 is an element where the potential changes (decreases) from the reference potential Vb which corresponds to the standard volume of the pressure chamber 38 to the first micro-vibration expansion potential VL2 (equivalent to the first potential in the invention) on the negative electrode side with respect to the reference potential Vb. The first micro-vibration expansion potential VL2 is a value between the reference potential Vb and the first expansion potential VL1 of the ejection driving pulse DP. Here, each of the potential gradients of the first vibration expanding section p21, the vibration shrinking section p23, the second vibration expanding section p25, and the vibration shrinking restoration section p27 are respectively set as values where the ink (ink for textile printing) inside the nozzles 37 and inside the pressure chambers 38 may be vibrated to an extent that the ink is not ejected from the nozzles 37 when the first vibration expanding section p21 is applied to the piezoelectric element 33. In addition, the first vibration expansion holding section p22 is a waveform element where the first micro-vibration expansion potential VL2 which is an end potential of the first vibration expanding section p21 is maintained for a predetermined time.

The vibration shrinking section p23 is a waveform element which is generated after the first vibration expansion holding section p22 and a waveform element where the potential changes (increases) with a constant gradient from the first micro-vibration expansion potential VL2 to a micro-vibration shrinking potential VH2 (equivalent to the second potential in the invention) exceeding the reference potential Vb on the positive electrode side in relation thereto. The vibration shrinking holding section p24 is a waveform element where the micro-vibration shrinking potential VH2 which is an end potential of the vibration shrinking section p23 is maintained for a predetermined time. The second vibration expanding section p25 is a waveform element where the potential changes from the micro-vibration shrinking potential VH2 to the first micro-vibration expansion potential VL2 (equivalent to the third potential in the invention) on the negative electrode side. The second vibration expansion holding section p26 is a waveform where the second micro-vibration expansion potential VL3 is maintained for a predetermined time. In addition, the vibration shrinking restoration section p27 is a waveform element where the potential is restored with a constant gradient from the second micro-vibration expansion potential VL3 to the reference potential Vb.

While typical micro-vibration driving pulses of the related art (for example, a vibration driving pulse VP' to be described later) vibrate ink inside a pressure chamber and inside a nozzle by expanding and shrinking (or shrinking and expanding) the pressure chamber once each, the micro-vibration driving pulses VP in the present embodiment vibrate and stir the ink inside the pressure chambers 38 and inside the nozzles 37 by repeatedly expanding and shrinking (or shrinking and expanding) the pressure chambers 38 twice each. Then, even in a case where the stirring effect of the ink is improved by setting the vibration shrinking section p23 so as to change the volume of the pressure chamber 38 to a greater extent and more quickly, it is possible to for the shrinking holding section p24, the second vibration expanding section p25, the second vibration expansion holding section p26, and the vibration shrinking restoration section p27 to function as a waveform element which suppresses the pressure vibration which occurs in the pressure chamber 38. Accordingly, in a case where the micro-vibration is performed using the micro-vibration pulse VP, since the movement of the meniscus after the micro-vibration is suppressed while the thickening of the ink is suppressed by increasing the stirring effect, it is possible to secure the ejection stability of the ink in the subsequent ejecting operation. Then, since the ink for textile printing in the present embodiment has a low moisture retaining property compared to the aqueous dye ink and thickens easily, it is possible to suppress the progress of the thickening of the ink for textile printing by performing the micro-vibration according to the micro-vibration driving pulse VP in a case where the ink is not ejected in a predetermined cycle. Here, the waveform length (the time from the start edge of the first vibration expanding section p21 to the end edge of the vibration shrinking restoration section p27) of the micro-vibration driving pulse VP is long compared to a typical micro-vibration driving pulse of the related art. The details of this point will be described later.

Here, the target ink amount and flying speed are obtained in a case where the ink for textile printing is ejected on a one-off basis (that is, once and without continuously ejecting ink) using the ejection driving pulse DP described above; however, there is a tendency for the residual vibration to be larger. Accordingly, in a case where the ink for textile printing is continuously ejected, in particular, in a case of ejecting at a higher frequency, it is difficult to eject the ink in a stable manner due to the adverse influence of the residual vibration. That is, there is a concern that the change in the amount or the flying speed (the flying direction) of the ink which is ejected from the nozzle 37 will be large. Thus, in the printer 1 according to the invention, the adverse influence of the residual vibration on the ejection is reduced by optimizing the arrangement (the generation timing) of each of the driving pulses in the driving signal. Below, description will be given of this point.

Figure 7:
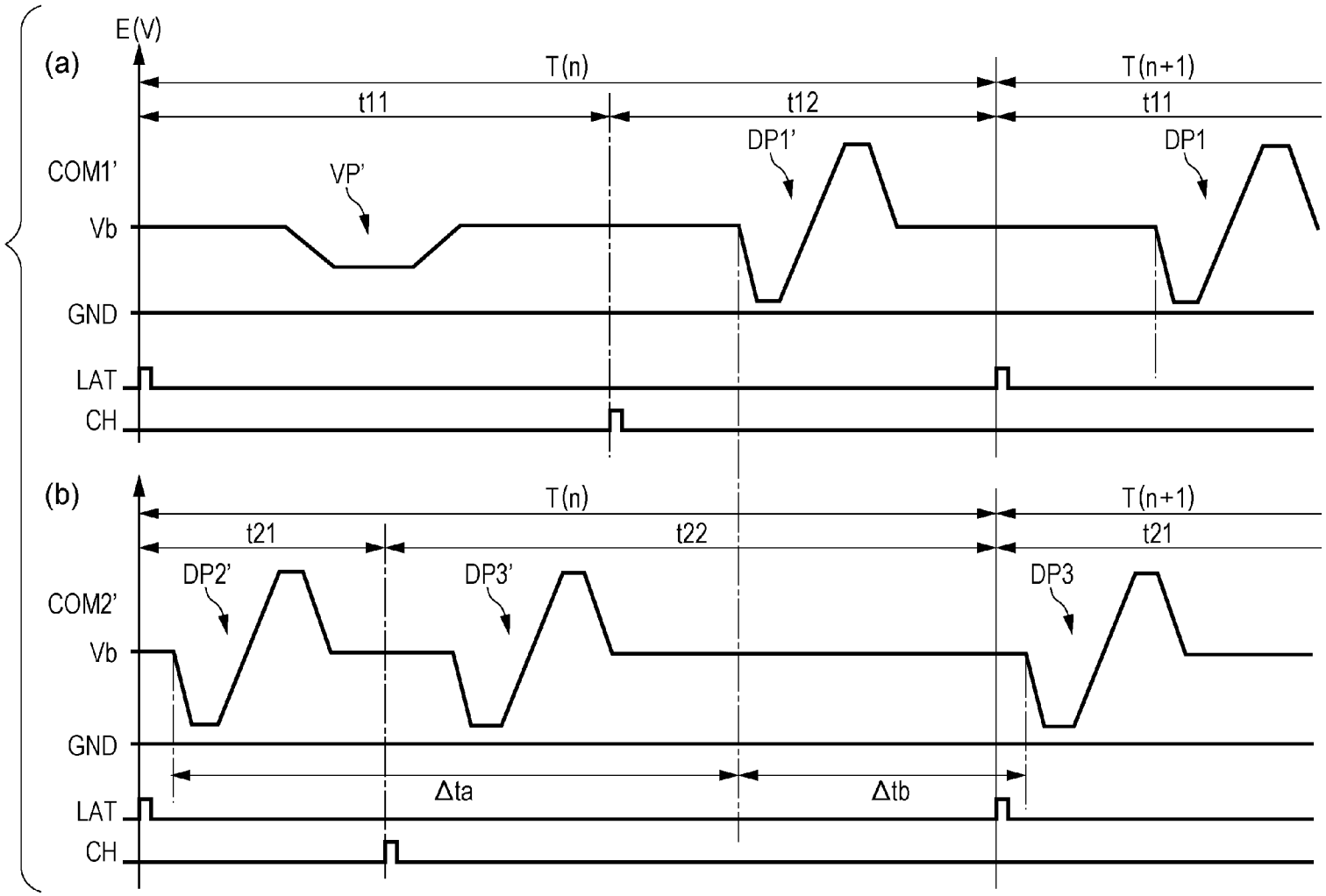
FIG. 7 is a waveform diagram which illustrates a configuration of a driving signal in the related art.

Firstly, description will be given of a configuration example of a driving signal of the related art for ejecting a typical aqueous ink by referring to FIGS. 7(*a*) and 7(*b*) for comparison. A first driving signal COM1' in the example generates a micro-vibration driving pulse VP' and a first ejection driving pulse DP1' within a unit cycle T and a second driving signal COM2' generates a second ejection driving pulse DP2' and a third ejection driving pulse DP3' within a unit cycle T. These ejection driving pulses DP1' to DP3' all have the same waveform. Then, in a case where large dots are formed, the second ejection driving pulse DP2' of the second driving signal COM2', the third ejection driving pulse DP3', and the first ejection driving pulse DP1' of the first driving signal COM1' are selected in this order and sequentially applied to the piezoelectric element. In the same manner, in a case where medium dots are formed, the second ejection driving pulse DP2' of the second driving signal COM2' and the first ejection driving pulse DP1' of the first driving signal COM1' are selected in this order and sequentially applied to the piezoelectric element. In addition, in a case where small dots are formed, only the third ejection driving pulse DP3' of the second driving signal COM2' is selected and applied to the piezoelectric element. Then, in a case where ink is not ejected in a predetermined cycle, the ink (meniscus) is micro-vibrated to an extent where the ink is not ejected by the vibration driving pulse VP' of the first driving signal COM1' being applied to the piezoelectric element.

Here, on the premise of a state where the recording head moves at a relatively constant speed with respect to the recording medium, in a case where medium dots are continuously formed, that is, in a case where medium dots are formed in a predetermined cycle T(n) and medium dots are also formed in the next cycle T(n+1), an interval at which ink is ejected from a nozzle (an interval at which a driving pulse is applied to a piezoelectric element) will be focused on. In the configuration in FIGS. 7(*a*) and 7(*b*), an interval Δtb between the first ejection driving pulse DP1' of the cycle T(n) and the second ejection driving pulse DP2' of the cycle T(n+1) is different with respect to an interval Δta between the second ejection driving pulse DP2' and the first ejection driving pulse DP1' which are selected when the medium dots are formed. Due to this, in a case where medium dots are continuously formed over a plurality of continuous cycles, the ejecting intervals of the ink vary. Due to this, the state of the residual vibration (the amplitude or the phase) at the time of ejection according to the first ejection driving pulse DP1' after the ejection according to the second ejection driving pulse DP2' in the same cycle and the state of the residual vibration at the time of ejection according to the second ejection driving pulse DP2' of the cycle T(n+1) after the ejection according to the first ejection driving pulse DP1' of the cycle T(n) are different and there is a concern that the amount or the flying speed of ink which is ejected will not be stable. In particular, since the residual vibration is slightly larger in a configuration where ink for textile printing is ejected, it is also easy for the adverse influence of the residual vibration to become great with respect to the ejection which is continuously performed thereafter. Then, since the usage rate (the generation rate in an image or the like) of medium dots is high in comparison with large dots or small dots in the transfer textile printing, it is necessary to obtain stable ejection characteristics (liquid amount and flying speed) regardless of the ejection frequency.

With respect to this, the driving signals COM1 and COM2 in the present embodiment are configured such that the intervals at which the ink is ejected are set to be constant in a case where dots of various sizes are continuously formed with respect to the transfer sheet S in a state where the recording head 6 moves at a constant speed. More specifically, as shown in FIG. 4, the interval between the first ejection driving pulse DP1 and the second ejection driving pulse DP2 and the interval between the second ejection driving pulse DP2 of a cycle T(n) and the first ejection driving pulse DP1 of a cycle T(n+1) are set to be Δt1. Due to this, in a case where medium dots are continuously formed over a plurality of continuous cycles, the ejecting intervals of the ink are set to be constant. By setting the intervals at which the ink is ejected to be constant, the size of the residual vibration during each ejection (the residual vibration which is generated by the ejection immediately prior thereto) is substantially averaged without variations, in other words, the extent of the absolute influence with respect to the next ejection due to the residual vibration is reduced since the residual vibration due to the ejection which was performed previously is at least suppressed from being extremely large at the time when ejection is performed. Due to this, each of the ejections are stable. As a result, even in a case where ink for textile printing is ejected, the target ink amount and flying speed are obtained regardless of the ejection frequency and stable ejection is possible. Here, that the "ejecting intervals are set to be constant" does not necessarily limit the intervals to being the same and some difference is tolerated.

In the same manner, the interval between the third ejection driving pulse DP3 and the fourth ejection driving pulse DP4, the interval between the fourth ejection driving pulse DP4 and the second ejection driving pulse DP2, and the interval between the second ejection driving pulse DP2 of a cycle T(n) and the third ejection driving pulse DP3 of a cycle T(n+1), which are selected when large dots are formed, are each set to be Δt2. Due to this, even in a case where large dots are continuously formed over a plurality of continuous cycles, the ejecting intervals of the ink are set to be constant. Here, regarding the small dots, since only the fourth ejection driving pulse DP4 is selected in each of the cycles, in a state where the recording head 6 moves at a relatively constant speed with respect to the recording medium, the ejecting intervals of the ink are set to be constant even in a case where the small dots are continuously formed over a plurality of continuous cycles.

Thus, in the printer 1 of the present embodiment which handles ink for textile printing, in a case where dots of various sizes are continuously formed with respect to the transfer sheet S, since the intervals at which the ink is ejected are configured to be constant, the target ink amount and flying speed are obtained regardless of the ejection frequency and it is possible to secure the ejection stability. In particular, since the usage rate of the medium dots whose size is between large dots and small dots is high in a transfer textile printing system, the effectiveness is increased. Due to this, it is desirable to set the ejecting intervals to be constant at least when the medium dots are formed. Then, since it is possible to secure the ejection stability, the printer 1 described above is suitable for applications which eject a liquid where the surface tension is 22 [mN] or more to 25 [mN] or less.

In addition, regarding the micro-vibration driving pulse VP in the present embodiment, since the waveform length is long while the residual vibration is smaller in comparison with the micro-vibration driving pulse VP' of the related art, in a case where the ejection of ink is performed with higher frequency, that is, in a case where the time until the next ejection after the micro-vibration is shorter, there is a tendency for the influence of the residual vibration to easily appear. However, in the present embodiment, since the intervals at which the ink is ejected are configured to be constant, the size of the residual vibration at the time of each ejection is substantially averaged and the waveform length of the micro-vibration driving pulse VP in the present embodiment is long but the residual vibration is small, whereby the extent of the absolute influence with respect to the next ejection due to the residual vibration is reduced in comparison with a configuration where there are large variations in the magnitude of the residual vibration during ejection. Due to this, each of the ejections are stable.

Figure 8:
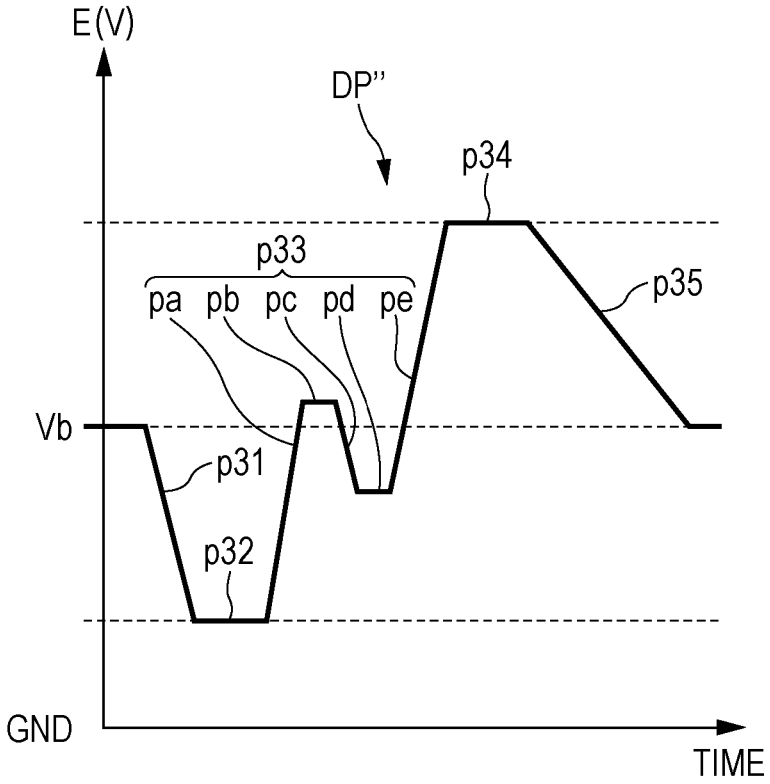
FIG. 8 is a waveform diagram which illustrates a configuration of a modification example of an ejection driving pulse.

Here, regarding the ejection driving pulse DP, it is possible to adopt various types of configurations without being limited to the examples in the embodiments described above. For example, an ejection driving pulse DP" in the modification example shown in FIG. 8 is different from the ejection driving pulse DP described above in the point of being configured by a first shrinking section p33 including a first shrinking element pa which shrinks the pressure chamber 38, an intermediate holding element pb which maintains the shrinking state of the pressure chamber 38, a re-expanding element pc which re-expands the pressure chamber 38, a re-expansion holding element pd which maintains the re-expansion state of the pressure chamber 38 for a certain time, and a second shrinking element pe which re-shrinks the pressure chamber 38. In other respects, the configuration is substantially the same as the ejection driving pulse DP described above. The ejection driving pulse DP" is a driving pulse which is able to eject more minute ink droplets. Then, since the expanding and shrinking of the pressure chamber 38 are repeated more often in comparison with the ejection driving pulse DP, the residual vibration is large. Thus, even in a case of adopting the ejection driving pulse DP" where the residual vibration after the ink ejection is comparatively large, it is possible to suppress the influence of the residual vibration as long as the ejecting intervals are constant, the target ink amount and flying speed are obtained regardless of the ejection frequency, and it is possible to secure the ejection stability.

Here, in the embodiment described above, the piezoelectric element 33 which is a so-called bending vibration type is given as an example of a pressure generating means; however, it is possible to adopt a piezoelectric element which is, for example, a so-called longitudinal vibration type without being limited thereto. In this case, each of the driving pulses which are given as examples in the embodiment described above has a waveform where the changing direction of the potential, that is, up and down, is reversed.

In addition, the pressure generating means is not limited to a piezoelectric element and it is possible to apply the invention even in a case of using various types of pressure generating means such as an electrostatic actuator which changes the volume of the pressure chamber using electrostatic power.

In addition, in the embodiment described above, the printer 1 with a configuration where ink for textile printing is ejected with respect to the transfer sheet S while moving the recording head 6 in the main scanning direction is given as an example; however, without being limited thereto, it is also possible to apply the invention to, for example, a so-called line type printer which is provided with a recording head where the total length of a nozzle row is set to be a length which corresponds with the maximum printable width of the transfer sheet S and which ejects ink while transporting the transfer sheet S in a state where the position of the recording head is fixed. In this case, it is sufficient if the ejecting intervals of the ink for textile printing are constant in a state where the transporting speed of the transfer sheet S is constant.

Then, the invention is not limited to the printer described above as long as the printer is a liquid ejecting apparatus which ejects a liquid where the surface tension is comparatively low and where the influence of the residual vibration at the time of ejection is a problem and it is possible to apply the invention to various types of ink jet recording apparatuses such as a plotter, a facsimile apparatus, and a photocopy machine, or liquid ejecting apparatuses other than a recording apparatus, for example, a display manufacturing apparatus, an electrode manufacturing apparatus, a chip manufacturing apparatus, and the like.

REFERENCE SIGNS LIST

1: printer, 6: recording head, 9: control section, 11: driving signal generating section, 33: piezoelectric element, 37: nozzle, 38: pressure chamber, 43: ink supply opening

The invention claimed is:

1. A liquid ejecting apparatus comprising:

a liquid ejecting head which ejects a liquid where a surface tension is 22 [mN] or more and 30 [mN] or less from a nozzle, wherein ejecting intervals are set to be constant when the liquid is continuously ejected, wherein a vibration waveform is generated which vibrates the liquid to an extent that the liquid is not ejected from the nozzle by driving a pressure generating means, and the vibration waveform has a first element which changes from a reference potential to a first potential, a second element which changes from the first potential to a second potential exceeding the reference potential, a third element which changes from the second potential to a third potential on the first potential side, and a fourth element which changes from the third potential to the reference potential.

2. The liquid ejecting apparatus according to claim 1, wherein the liquid which is ejected from the liquid ejecting head relates to one or more landing droplets which are formed by landing on a landing target, and the liquid ejecting head is configured to form first landing droplets of which the relative size is the smallest, second landing droplets of which the relative size is the largest, and third landing droplets with a size between the first landing droplets and the second landing droplets, and ejecting intervals are set to be constant at least when the third landing droplets are formed.

3. The liquid ejecting apparatus according to claim 2, wherein ejecting intervals are set to be constant when the first landing droplets are formed and ejecting intervals are set to be constant when the second landing droplets are formed.

4. The liquid ejecting apparatus according to any one of claims 1 to 3, wherein the liquid includes a dispersion dye and at least one type of silicon-based surfactant or fluorine-based surfactant.

5. The liquid ejecting apparatus according to any one of claim 1 to 3 or 4, wherein the surface tension of the liquid is 22 [mN] or more and 25 [mN] or less.

6. The liquid ejecting apparatus according to any one of claim 1 to 3 or 4 or 5, wherein the liquid includes a penetrating agent with a HLB value of 17 or more and 30 or less.

* * * * *